United States Patent [19]

Szarka

[11] Patent Number: 4,984,960

[45] Date of Patent: Jan. 15, 1991

[54] VACUUM TRACK AND PALLETS

[75] Inventor: Sandor Szarka, Franklin Lakes, N.J.

[73] Assignee: Precision Screen Machines, Inc., Hawthorne, N.J.

[21] Appl. No.: 442,920

[22] Filed: Nov. 29, 1989

[51] Int. Cl.[5] ..... B65D 17/00

[52] U.S. Cl. ..... 414/752; 414/676; 271/1; 271/195; 269/21; 101/407.1; 198/471.1; 198/803.5

[58] Field of Search ..... 414/676, 752; 198/471.1, 803.5, 493; 271/194, 195, 1; 269/20, 21; 101/407.1, 474, 126

[56] References Cited

U.S. PATENT DOCUMENTS

| | | | |
|---|---|---|---|
| Re. 29,206 | 5/1977 | Jaffa | 101/407.1 |
| 2,967,568 | 1/1961 | Friday | 198/493 X |
| 3,452,883 | 7/1969 | Watters | 414/676 |
| 3,990,689 | 11/1976 | Eklund, Sr. | 269/21 |

*Primary Examiner*—Frank E. Werner
*Assistant Examiner*—William M. Hienz
*Attorney, Agent, or Firm*—Hopgood, Calimafde, Kalil, Blaustein & Judlowe

[57] ABSTRACT

An apparatus having a vacuum track, and a vacuum pallet for use therewith. The apparatus comprises a vacuum duct having a single vacuum pump and a plurality of ports which individually open when said vacuum pallet passes thereover. The pallet has a shoe which fits snugly over the port to facilitate evaculation of the pallet, and has small holes in the article-supporting surface through which the vacuum acts to hold an article in place thereon.

5 Claims, 3 Drawing Sheets

VACUUM TRACK AND PALLETS

BACKGROUND OF THE INVENTION

This invention relates to a screen printing machine employing vacuum pallets to support and register the article to be printed upon. This invention relates especially to a means for supplying a vacuum to said pallets, and to a vacuum pallet itself.

Silk screen printing is a well-known technique for producing articles that have decorative patterns or words printed thereon. Such printing has been used for a variety of articles, such as T-shirts, socks, posters and the like. A pallet is commonly used to support and position the article for printing. When a T-shirt is decorated, for example, it is usually slipped over a pallet which is then positioned under the printing head. In this way, article handling is facilitated and a flat printing surface is assured.

In some applications, e.g., when printing large posters, a different method of supporting and registering the article is needed. One such method is the use of a vacuum pallet; this is a pallet having a vacuum chamber in its interior, at least one port through which the chamber may be evacuated, and small holes through the article-receiving surface so that the vacuum will hold the article in place on the pallet. A vacuum pallet, and associated apparatus, is described in U.S. Pat. No. 3,763,776, the disclosure of which is incorporated herein by reference.

Because each pallet must be mobile, it is common practice to supply each vacuum pallet with its own small motor to generate a vacuum. This arrangement has several disadvantages. A great deal of noise is generated, since a large number of pallets having motors is commonly needed. The weight of each pallet is greatly increased by the motor attached thereto. Furthermore, there are severe practical limitations on motor size, and thus on vacuum power, because large motors are not suitable for mobile pallets. In addition, a great deal of vibration is produced by the motors, and such vibration may affect the steadiness of the pallet during printing operations.

SUMMARY OF THE INVENTION

The vacuum track apparatus of this invention comprises: a frame; a vacuum duct, supported by said frame, having a plurality of ports; a vacuum means operatively connected to said duct; a pallet advancing means attached to said frame for moving vacuum pallets over said ducts and positioning the pallets at one or more operating stations; and, port means responsive to the movement of the pallets for opening and closing said ports, said port means adapted to individually open said ports when a pallet is passing thereover and to otherwise keep said ports closed.

The vacuum pallet of this invention comprises: an upper and a lower plate member interconnected by end members to define a vacuum chamber therein, said upper plate member having a plurality of small openings disposed in open communication with said chamber, and said lower plate member having one larger opening therethrough; an open lattice or honeycomb-like structure between said plate members to provide structural support; a shoe mounted over said lower plate opening adapted to fit snugly over a vacuum port to facilitate evacuation of said chamber; and, a means for activating the port means for opening the vacuum port when said shoe is positioned thereover.

OBJECTS OF THE INVENTION

One object of the present invention is to provide an apparatus having a vacuum track connected to a single vacuum source, which apparatus includes a pallet advancing means and vacuum ports adapted to evacuate a vacuum pallet passing thereover.

Another object of this invention is to provide a screen printing machine having a vacuum track so that a number of vacuum pallets may be evacuated by a single vacuum source.

It is also an object of this invention to provide a vacuum pallet having a shoe and activating means for use in conjunction with a vacuum track.

Another object of this invention is to provide a relatively lightweight vacuum pallet assembly.

A further object of this invention is to provide an apparatus capable of efficiently producing high quality printed images on thin, nonporous articles.

Yet another object of this invention is to provide an apparatus in which a single motor supplies a vacuum to associated vacuum pallets and also blows air out at a feed table to cause an article to float on an air cushion while the article is being positioned on a pallet.

Other objects and advantages of this invention will be evident to those skilled in the art from the following description of the preferred embodiments and from the drawings.

DETAILED DESCRIPTION OF THE PREFERRED EMBODIMENTS

Figure 1:
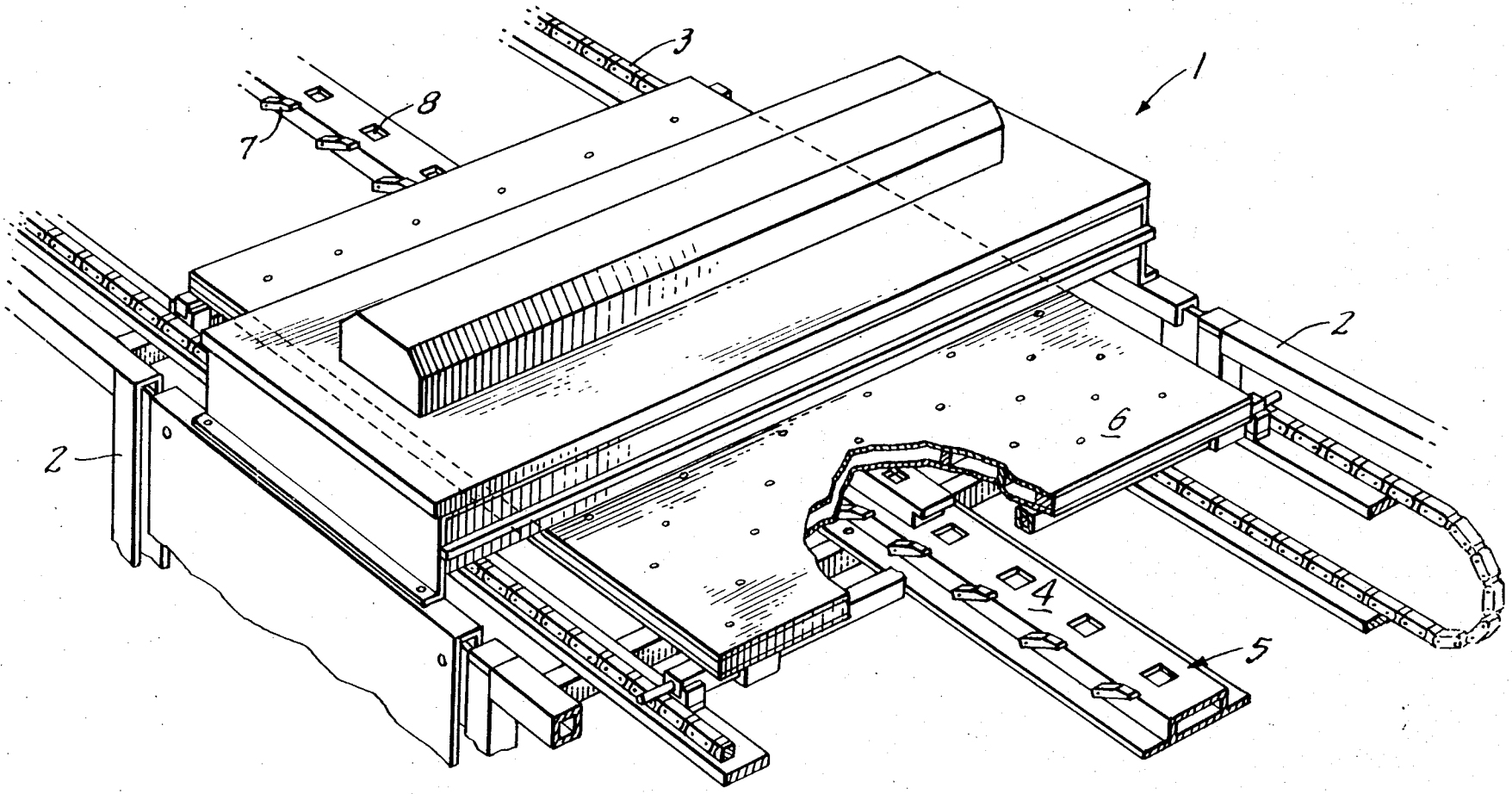
FIG. 1 is a perspective view of a section of a vacuum track apparatus and an associated vacuum pallet according to the present invention.
Figure 3:
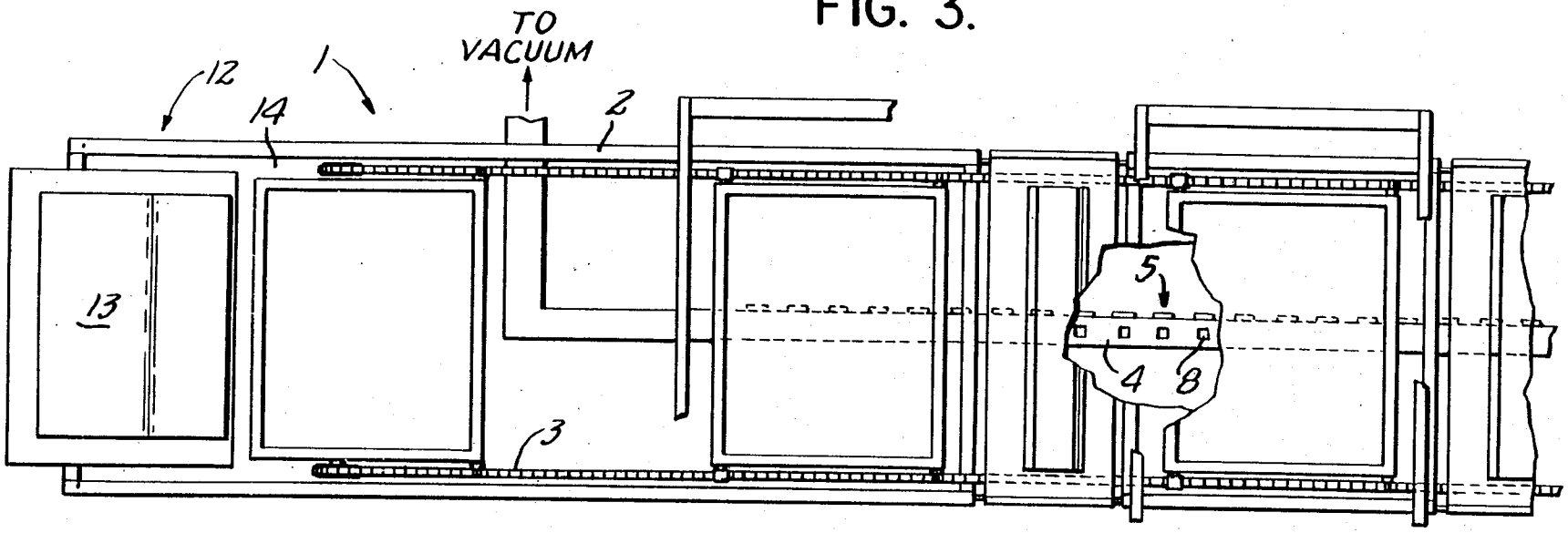
FIG. 3 is a top plan view of the apparatus shown in FIG. 2.
Figure 2:
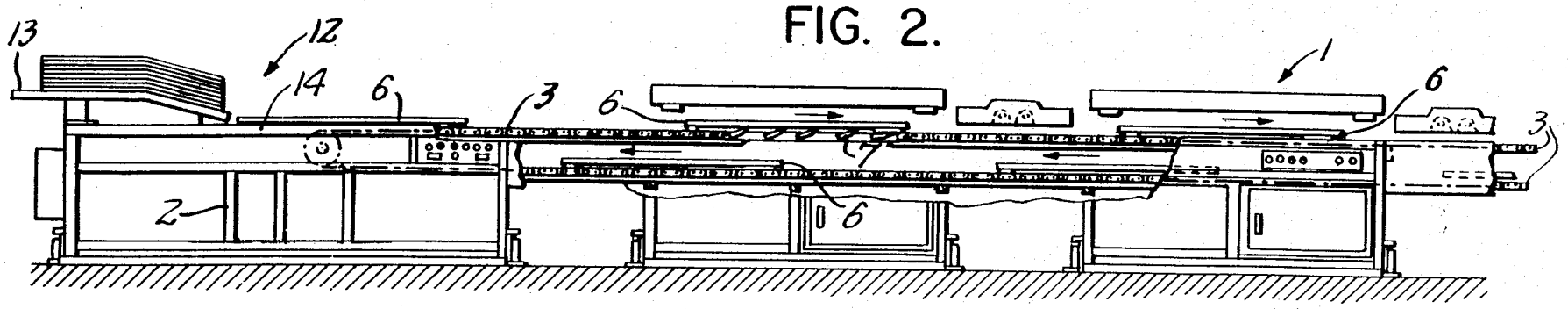
FIG. 2 is a side elevation of the vacuum track apparatus depicted in FIG. 1.

FIGS. 1–5 illustrate one embodiment of the vacuum track apparatus 1 of this invention. This apparatus 1 includes a frame 2 supporting a pallet advancing means 3 and a vacuum duct 4. The duct 4 contains a plurality of ports 9, each having an associated port means 5, which open when a pallet 6 advances thereover and activates the port means 5. The duct 4 is connected to a vacuum means which produces sub-atmospheric pressure inside the duct 4, so that the pallet 6 experiences a vacuum effect when the port 9 opens thereunder.

The port means 5 comprises: a pin 10 which is rotatably mounted through the sides of the vacuum duct 4 and one end of which protrudes from one side of the duct 4; a port lever 7 having a first end rigidly mounted on said end of the pin 10; a port cover 8 one end of which is mounted on the pin 10 inside the duct 4; and a compression spring 11 located inside the duct 4 between the bottom surface of the duct 4 and the cover 8.

The compression spring 11 presses the cover 8 against the port 9, sealing the port 9 to prevent loss of the vacuum. When the port means 5 is in this closed position, the lever 7 is oriented so that its second end is higher than the top surface of the duct 4. When a pallet 6 passes over the port 9 it activates the port means 5 by pushing the lever 7 forward and downward; this movement of the lever 7 forces the pin 10 to rotate, in turn causing the port cover 7 to pivot downward, away from the port 9, compressing the spring 11, and allowing air to be drawn into the duct 4 through the port 9. After the pallet 6 departs and releases the lever 7, the spring 11 once again presses the cover 8 against the port 9, sealing the vacuum duct 4.

In a preferred embodiment of the invention, there is a feed section 12 at one end of the apparatus 1 comprising a feed table 13 and a first station 14 wherein the vacuum exhaust blows a positive pressure air flow through a pallet 6 placed on the first station 14. When an article, e.g. a sheet of paper, is placed on the table 13 it slides onto the pallet 6 and floats slightly above the surface thereof due to the positive air flow, facilitating the positioning of the article upon the pallet 6. When the advancing means 3 carries the pallet 6 to the vacuum section of the apparatus 1, the vacuum holds the article firmly in place.

Figure 6:
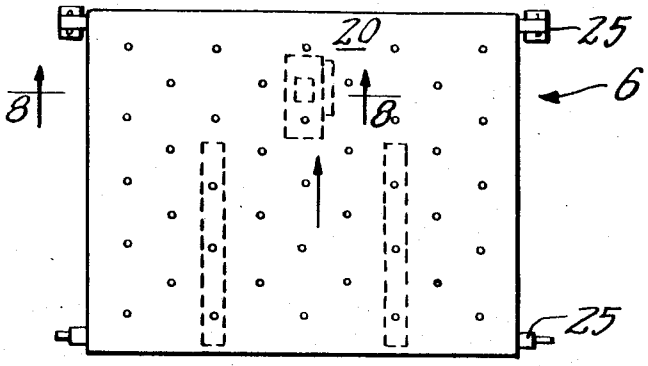
FIG. 6 is a top plan view of a vacuum pallet according to this invention.
Figure 7:
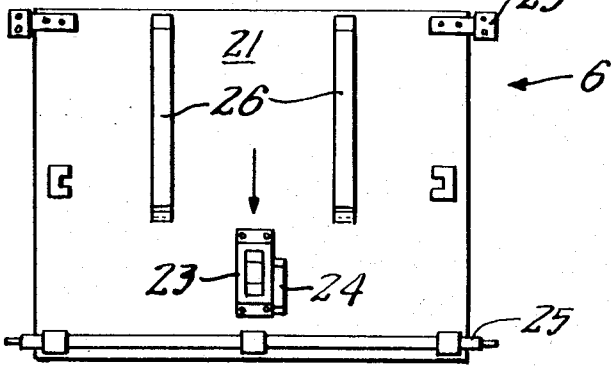
FIG. 7 is a bottom plan view of the pallet of FIG. 6.
Figure 8:
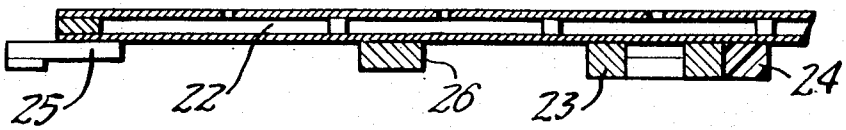
FIG. 8 is a detailed sectional view of the pallet taken along line 8—8 of FIG. 6.
Figure 4:
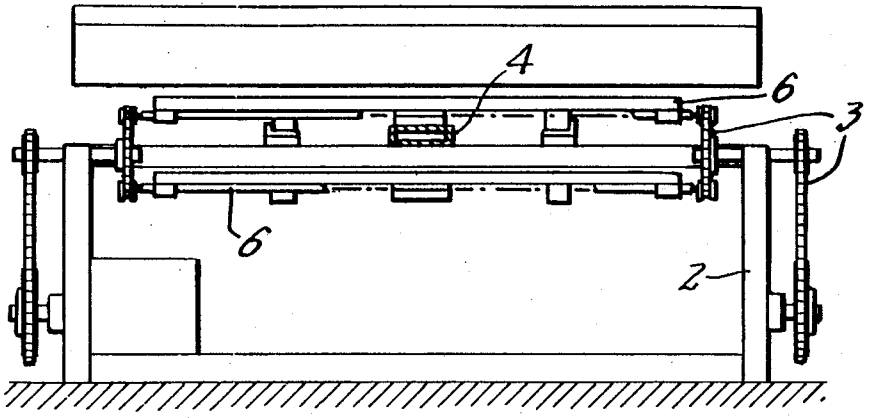
FIG. 4 is an end view of the apparatus of FIG. 2.
Figure 5:
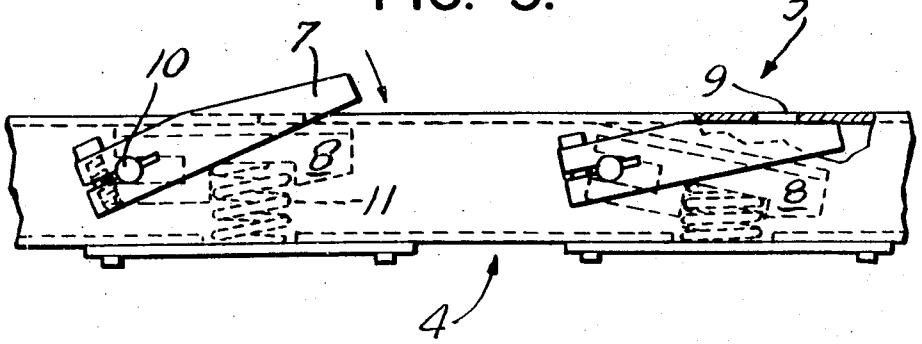
FIG. 5 is a detailed side elevation of the vacuum port assembly of the apparatus shown in FIG. 1 illustrating the interior mechanism in both the closed and open positions.

Referring to FIGS. 6–8, the pallet 6 of this invention comprises an upper plate member 20 and a lower plate member 21 interconnected by end members to define a vacuum chamber 22 therein. The upper plate member 20 has a plurality of small openings or perforations disposed in open communication with the chamber 22, while the lower plate member 21 has one larger opening therethrough; an open lattice or honeycomb-like structure between said plate members 20 and 21 provides structural support.

A shoe 23 is mounted over said lower plate opening, which shoe 23 is adapted to fit snugly over a vacuum track port 9 to facilitate evacuation of the chamber 22. A port activating means 24 is mounted next to the shoe 23. When the shoe 23 of a pallet 6 moves over a port 9 of the apparatus 1, the activating means 24 pushes the lever 7 to the open position; the means 24 releases the lever 7 as the shoe 23 slides away from the port 9. Each time the shoe 23 is over an open vacuum port 9, the chamber 22 is subject to a vacuum which exerts suction on the pallet-supported article through the perforations of the upper plate member 20.

The pallet 6 also includes linkage means 25 for engaging the pallet advancing means 3, and optionally may include guides 26 on the lower plate member 21.

Although specific types of port means and port activating means have been illustrate and described herein, it is understood that the invention is not limited to these particular embodiments. The invention encompasses all suitable means for accomplishing the opening and closing of the ports in response to the passage of a pallet thereover. For example, the port means could be electronically activated rather than mechanically activated. Furthermore, the port cover could slide open and closed instead of pivoting on a pin. Other embodiments within the scope and spirit of this invention will be apparent to those skilled in the art.

The vacuum track apparatus of this invention may comprise a screen printing machine, an apparatus for drying articles, or any apparatus in which a vacuum track may be employed.

The various parts of the pallet of the present invention may be constructed of any suitable materials, such as wood (including plywood), metal, metal alloys, plastic, composite materials, and the like.

Although particular embodiments of the present invention have been illustrated and described, other embodiments will occur to those skilled in the art. The present invention includes all embodiments consistent with the foregoing disclosure and falling within the scope of the appended claims.

I claim:

1. A vacuum track apparatus comprising:

a frame;

a vacuum duct, supported by said frame, having a plurality of ports spaced longitudinally along the duct;

a vacuum means operatively connected to said vacuum duct adapted to generate a vacuum in said duct;

a pallet advancing means mounted on said frame for moving one or more vacuum pallets over said ports and for positioning the pallets at one or more operating stations; and, actuating means responsive to the movement of pallets over said ports for opening and closing said ports, said actuating means mounted to said duct and adapted to individually open said ports when a pallet is passing thereover and to otherwise keep said ports closed.

2. A vacuum track apparatus according to claim 1 wherein said actuating means comprises:

a port shaft rotatably mounted substantially horizontally inside said vacuum duct and having a portion extending out through one side of said duct;

a port cover fixedly mounted on said shaft, said cover extending outwardly from said shaft toward one of said ports and adapted to seal said one port when said shaft is rotated;

a spring assembly mounted between said cover and the bottom of said duct, said spring assembly exerting an upward force on said cover to urge said cover into a closed position wherein said one port is sealed; and a lever fixedly mounted on said portion of said shaft and extending above said duct so that a passing pallet may push said lever, causing said shaft to rotate and thus force said cover downward, opening said port.

3. A vacuum track apparatus according to claim 1 further comprising a feed section at one end thereof for feeding and positioning an article upon one of said pallets, said feed section connected to the exhaust of said vacuum means so that air blows up through a pallet-supporting surface on said duct causing said article to float on a layer of air on said one pallet to facilitate positioning said article upon said one pallet.

4. A vacuum track apparatus according to claim 1 wherein said vacuum means comprises a single motor.

5. A vacuum track apparatus according to claim 1, wherein said vacuum pallets each comprise a shoe through which said respective pallet may be evacuated, said shoe adapted to fit snugly over said port, and comprise an activation means for cooperatively engaging said actuating means to open said port while said shoe is positioned thereover.

* * * * *